US006293259B1

(12) United States Patent
Kilgore et al.

(10) Patent No.: US 6,293,259 B1
(45) Date of Patent: Sep. 25, 2001

(54) AUTOMOTIVE FUEL SYSTEM HAVING A PRESSURE REGULATOR WITHOUT A MOVABLE DIAPHRAGM

(75) Inventors: Jason T. Kilgore, Newport News; Jan L. Bennett; Barry S. Robinson, both of Williamsburg, all of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/312,189

(22) Filed: May 14, 1999

(51) Int. Cl.[7] ..... F02M 37/04
(52) U.S. Cl. ..... 123/514; 123/457; 137/539
(58) Field of Search ..... 123/514, 509, 123/457, 510; 137/539, 539.5

(56) References Cited

U.S. PATENT DOCUMENTS 4,365,648 * 12/1982 Grothe ..... 137/539
4,700,741 * 10/1987 Murphy ..... 137/543.19
5,141,025 * 8/1992 Eichhorn et al. ..... 137/539.5
5,293,897 * 3/1994 Warga et al. ..... 137/493.3
5,398,655 * 3/1995 Tuckey ..... 123/456
5,413,077 * 5/1995 Hornby et al. ..... 123/457
5,573,033 * 11/1996 Litzel ..... 137/512.3
5,715,798 * 2/1998 Bacon et al. ..... 123/514
5,967,120 * 10/1999 Blanton et al. ..... 123/467
6,116,273 * 9/2000 Tarr et al. ..... 137/539

* cited by examiner

*Primary Examiner*—Carl S. Miller

(57) ABSTRACT

The fuel system includes a fuel tank for supplying fuel to a fuel rail having fuel injectors and a fuel pressure regulator for regulating the pressure of the fuel supplied to the fuel rail to a predetermined pressure. The pressure regulator includes a spring-biased ball movable toward and away from a valve seat with an intervening flow channel director. The flow channel director is sized to provide a substantially constant regulated pressure over a flow range typical for automotive engine use, i.e., a pressure of 350–430 kPa over a flow range of 20–50 kg/hr. The pressure regulator provides the predetermined regulated pressure without a movable diaphragm dividing the regulator into flow and non-flow chambers on opposite sides of the diaphragm.

21 Claims, 5 Drawing Sheets

AUTOMOTIVE FUEL SYSTEM HAVING A PRESSURE REGULATOR WITHOUT A MOVABLE DIAPHRAGM

TECHNICAL FIELD

The present invention relates to automotive fuel systems for supplying fuels at a regulated pressure to an automotive engine and particularly relates to a pressure regulator for supplying fuel at a predetermined pressure wherein the regulator does not contain a movable diaphragm as the pressure control mechanism.

BACKGROUND

In typical pressure regulators for automotive fuel systems, there is often provided a pressure regulator having a movable wall or diaphragm dividing the regulator into chambers on opposite sides thereof at different pressures. The difference in pressure determines the position of the diaphragm, which in turn determines the size of a flow passage through the regulator. Thus, depending upon the difference in pressure on opposite sides of the diaphragm, the flow through the regulator is regulated to a predetermined pressure. In returnless fuel systems, for example, as illustrated in U.S. Pat. No. 5,413,077 of common assignee herewith, the disclosure of which is incorporated herein by reference, the diaphragm controls the position of a ball valve which is spring-biased toward a valve seat. Fuel flows past the spring and normally opened ball valve into a compartment on one side of the diaphragm for flow to a fuel rail. The opposite side of the diaphragm may have a vacuum reference. It will be appreciated that the difference in pressure between the chambers on the opposite sides of the diaphragm displaces the diaphragm, which in turn mounts a post for moving the ball valve away from the seat or permitting the ball valve to move toward the seat under the spring bias.

Such systems are eminently satisfactory for use in providing fuel to a fuel rail at a predetermined regulated pressure. It is well recognized that fuel systems with pressure regulators using diaphragms or movable walls have excellent performance characteristics. One of the advantages of the pressure regulator containing a diaphragm or movable wall is that a substantially constant pressure of fuel is supplied to the fuel rail over a full range of fuel flow. Varying pressure in the fuel rail would degrade engine performance. While such pressure regulators have been proven satisfactory, they require a substantial number of diverse parts, complicating assembly and causing increased associated costs. There has thus developed a need in a mechanical fuel system for a pressure regulator without a diaphragm or movable wall which provides the desired engine performance characteristics of substantially constant regulated fuel pressure over a wide range of flow conditions and which is relatively simple and inexpensive to manufacture.

DISCLOSURE OF THE INVENTION

In accordance with the present invention, there is provided a fuel system having a fuel pressure regulator without a movable diaphragm. Hence, the regulator of the present invention has a reduced number of parts, is inexpensive and simple to manufacture, and yet provides a substantially constant pressure of fuel over a wide range of fuel flow conditions suitable for an automotive engine without the use of a diaphragm. Particularly, the present invention provides a fuel system having a fuel rail for supplying fuel to the fuel injectors, a fuel tank for containing the fuel and a fuel pump for supplying the fuel at a certain pressure in the fuel system.

The fuel pressure regulator hereof is provided in the fuel line or in the fuel tank and regulates the pressure of the fuel supplied to the fuel rail to a predetermined pressure without use of the movable diaphragm or wall. The present invention is particularly useful in an automotive returnless fuel system where the regulator hereof is mounted close to or in the fuel tank and supplies a regulated higher pressure fuel from the fuel tank for regulation to a lower substantially constant fuel rail pressure by an integrated returnless fuel regulator and without return of fuel to the tank.

To accomplish this, the pressure regulator hereof includes a ball valve movable toward and away from a valve seat which also forms a fuel inlet for the pressure regulator. On the opposite side of the ball from the valve seat is a flow channel director which is particularly sized to enable fuel flow through the pressure regulator at a substantially constant pressure over the full range of flow rates for automotive engine usage. It has been discovered that by manipulating certain of the geometries of the flow channel director and particularly the flow outlet passage, a pressure regulator suitable for use in an automotive fuel system is provided without the necessity of a diaphragm or movable wall. Moreover, the pressure regulator hereof controls the pressure sufficiently accurately over the range of flow rates to enable elimination of the diaphragm or movable wall typical of most pressure regulators. The pressure regulator, in accordance with the present invention, is sized according to the output of particular pumps. For example, for large automobiles with large engines, different sizes of pressure regulators would be required in comparison with smaller automobiles with smaller engines. That is, the flow characteristics of the pressure regulator hereof is dependent upon the flow from the pump outlet. However, for a given fuel pump size, a substantially constant regulated pressure is provided over the desired range of fuel flow. For example, employing the pressure regulator hereof without a diaphragm or movable wall and using the properly sized flow channel director, a substantially constant regulated pressure over a full range of 20–150 kg/hr is achieved. As a general proposition, the foregoing is achieved where the flow channel director passage is in relation to the mass flow of fuel according to the following equation:

$$d=(0.52\pm0.02)\sqrt{m}$$

where d is the diameter of the channel in mm. and m is the mass flow rate in grams per second. By following this equation within the range indicated, substantially constant fuel pressure is provided over the desired fuel flow range.

In a preferred embodiment according to the present invention, there is provided a fuel system for an internal combustion engine comprising a fuel rail for supplying fuel to fuel injectors, a fuel tank for containing fuel, a fuel pump for supplying fuel from the fuel tank under pressure to the fuel rail, a fuel pressure regulator for regulating the pressure of the fuel supplied to the fuel rail to a predetermined pressure, the regulator including a housing and a valve seat in the housing having a fuel inlet, a valve element movable toward and away from the valve seat, a flow channel director mounting the valve element on an opposite side thereof from the seat and a spring for biasing the flow channel director and the valve element toward the valve seat, the flow channel director having a plurality of passages therethrough, the valve element being movable toward and away from the seat, enabling flow of fuel through the inlet between the valve element and seat and through the flow channel passages for regulating the fuel pressure to a substantially constant value over a predetermined range of flow.

In a further preferred embodiment according to the present invention, there is provided a fuel system for an internal combustion engine comprising a fuel rail for supplying fuel to fuel injectors, a fuel tank for containing fuel, a fuel pump for supplying fuel from the fuel tank under pressure to the fuel rail, a fuel pressure regulator for regulating the pressure of the fuel supplied to the fuel rail to a predetermined pressure, the pressure regulator being sized to provide a substantially constant regulated pressure over a flow range of 20–150 kg/hr and without a movable diaphragm dividing the regulator into flow and non-flow chambers on opposite sides thereof.

In a still further preferred embodiment according to the present invention, there is provided in a returnless fuel system for an internal combustion engine having a fuel rail for supplying fuel to fuel injectors, a fuel tank for containing fuel, a fuel pump for supplying fuel from the fuel tank under pressure to the fuel rail and a returnless fuel pressure regulator for regulating the pressure of the fuel supplied to the fuel rail to a predetermined pressure and located on or in a fuel supply line adjacent to the fuel rail, a method of operating the returnless fuel system comprising the steps of providing a second pressure regulator having a housing and a valve seat having a fuel inlet, a valve element movable toward and away from the valve seat, a flow channel director mounting the valve element on an opposite side thereof from the seat and a spring for biasing the flow channel director and the valve element toward the valve seat, the flow channel director having at least one passage therethrough whereby fuel flows through the inlet, between the valve element and the seat and the flow passage with the valve element being movable toward and away from the seat thereby regulating the fuel pressure to a substantially constant value over a predetermined range of flow.

BEST MODE FOR CARRYING OUT THE INVENTION

Figure 1A:
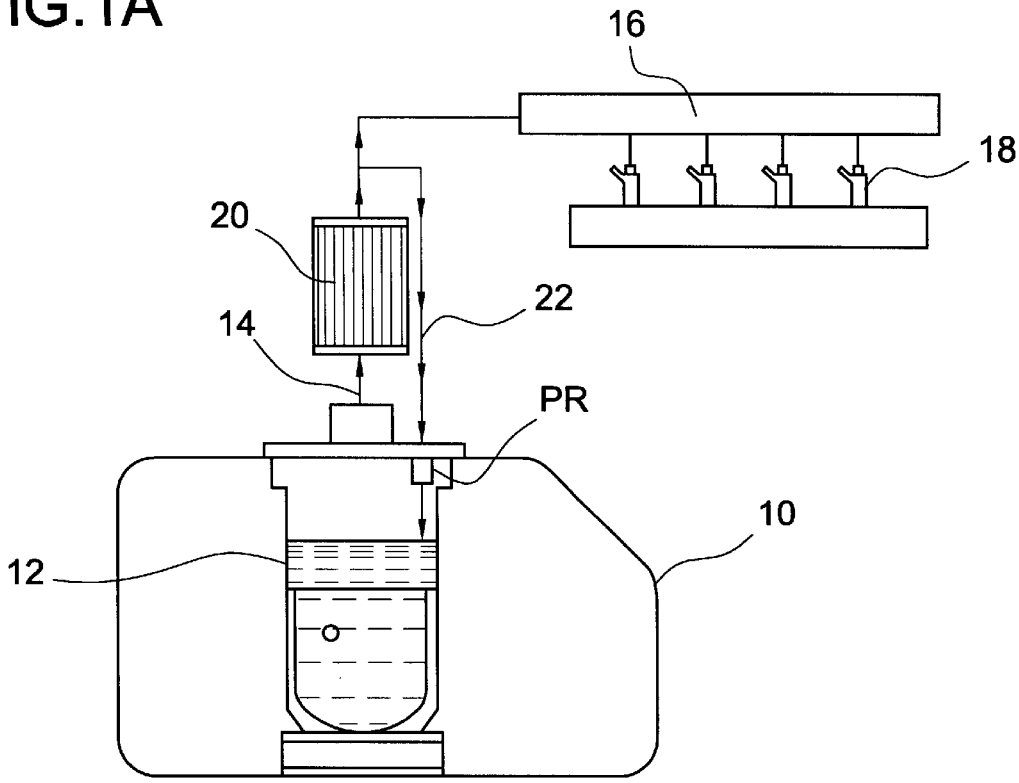
FIGS. 1A–1D are schematic illustrations of various locations of the pressure regulating valve constructed in accordance with the present invention in a fuel system.

Referring to the drawings, FIGS. 1A–1D schematically illustrate fuel systems in which a pressure regulator constructed in accordance with the present invention may be used. For example, in FIG. 1A, there is illustrated a fuel tank 10 containing a fuel pump 12 for pumping fuel via a conduit 14 into a fuel rail 16 in communication with fuel injectors 18, the latter forming part of an automotive engine. The fuel line 14 contains a filter 20 and downstream of the filter, a return line 22 flows fuel back into the fuel tank through the pressure regulator PR of the present invention. Note that the pressure regulator PR is located within the fuel tank 10.

Figure 1B:
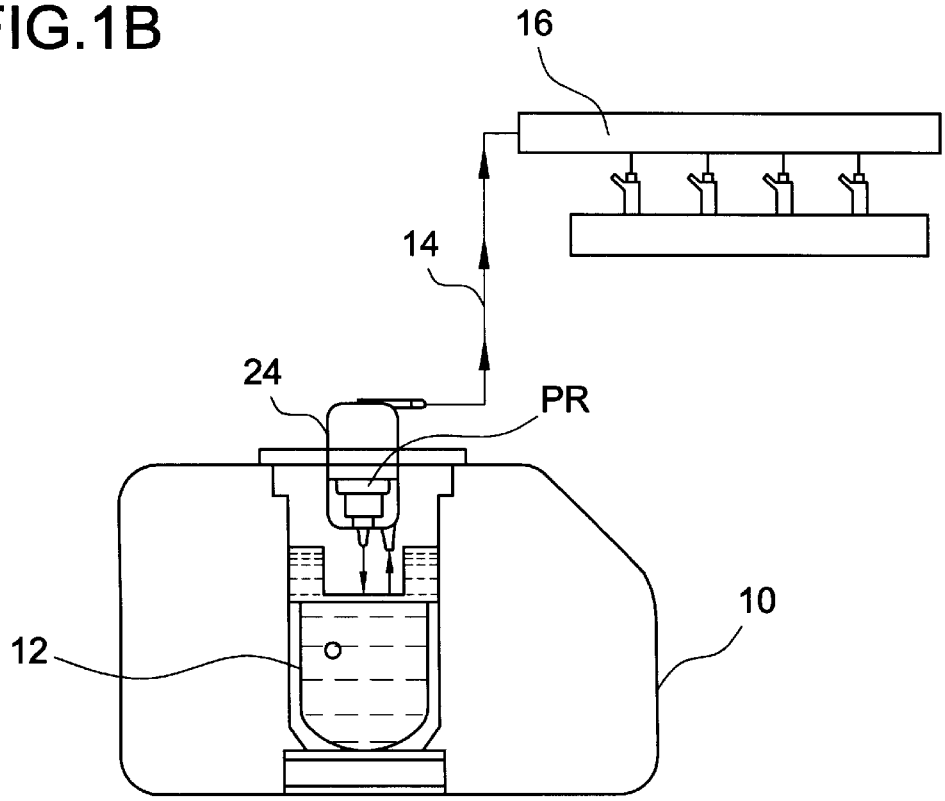

In FIG. 1B, a filter module 24 is disposed in the fuel tank 10 and a pressure regulator PR according to the present invention is located within the fuel module. The arrangement is generally the same as illustrated in FIG. 2, the fuel pump 12 pumping fuel from fuel tank 10 via a fuel line 14 to a fuel rail 16 with fuel return within the filter module 24 in the fuel tank.

Figure 1C:
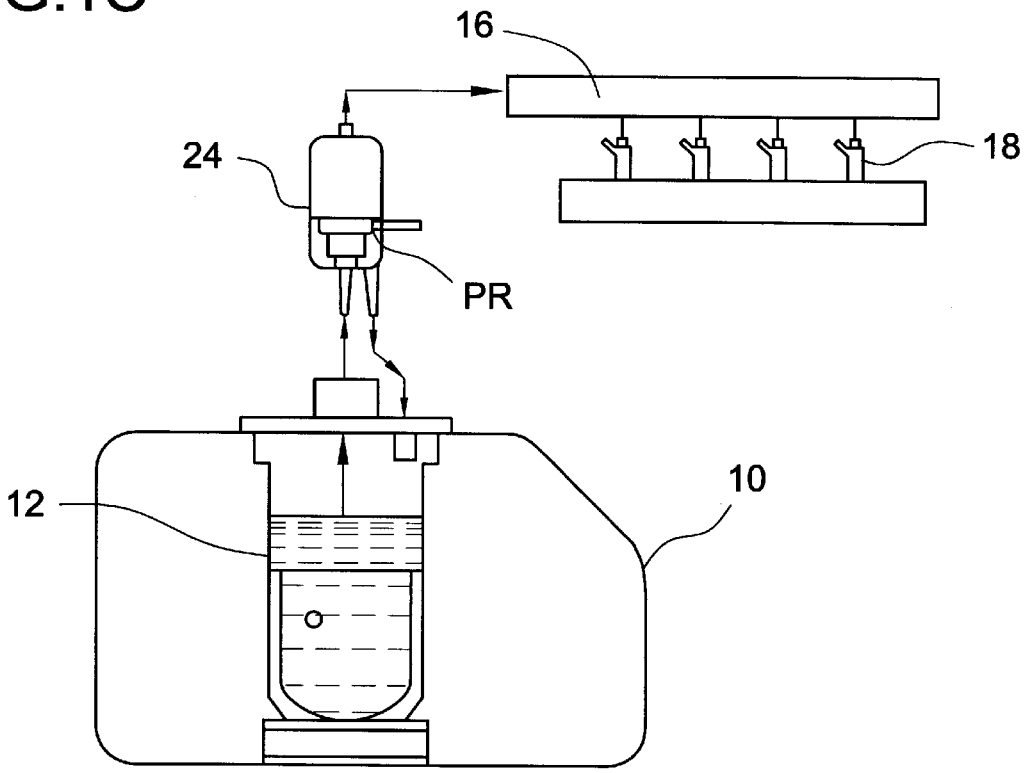

In FIG. 1C, the fuel filter module is located external to the fuel tank 10. The fuel pump 12 pumps the fuel through the filter module 24 to the fuel rail 16. The pressure regulator PR is located in the filter module providing a return to the fuel tank 10.

Figure 1D:
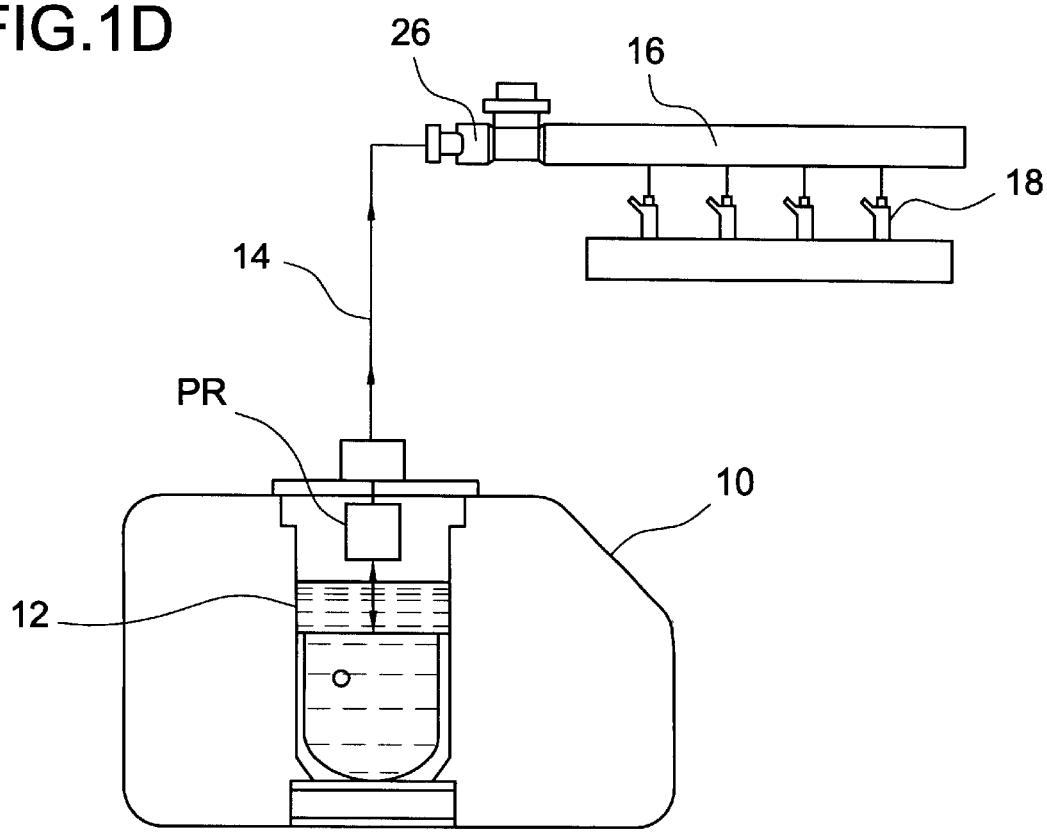

In FIG. 1D, the pressure regulator PR is located within the fuel tank and communicates via line 14 with an integral returnless regulator with damper 26 located on the fuel rail. The latter regulator may be of the type disclosed in U.S. Pat. No. 5,413,077, incorporated by reference. It will be appreciated that the pressure regulator in the embodiments of FIGS. 1A–1C constitutes the sole pressure regulator between the fuel pump and the fuel rail, while in FIG. 1D, the pressure regulator PR is employed in conjunction with an integral returnless regulator of the type indicated for supplying fuel to the fuel rail at a regulated pressure.

Figure 2:
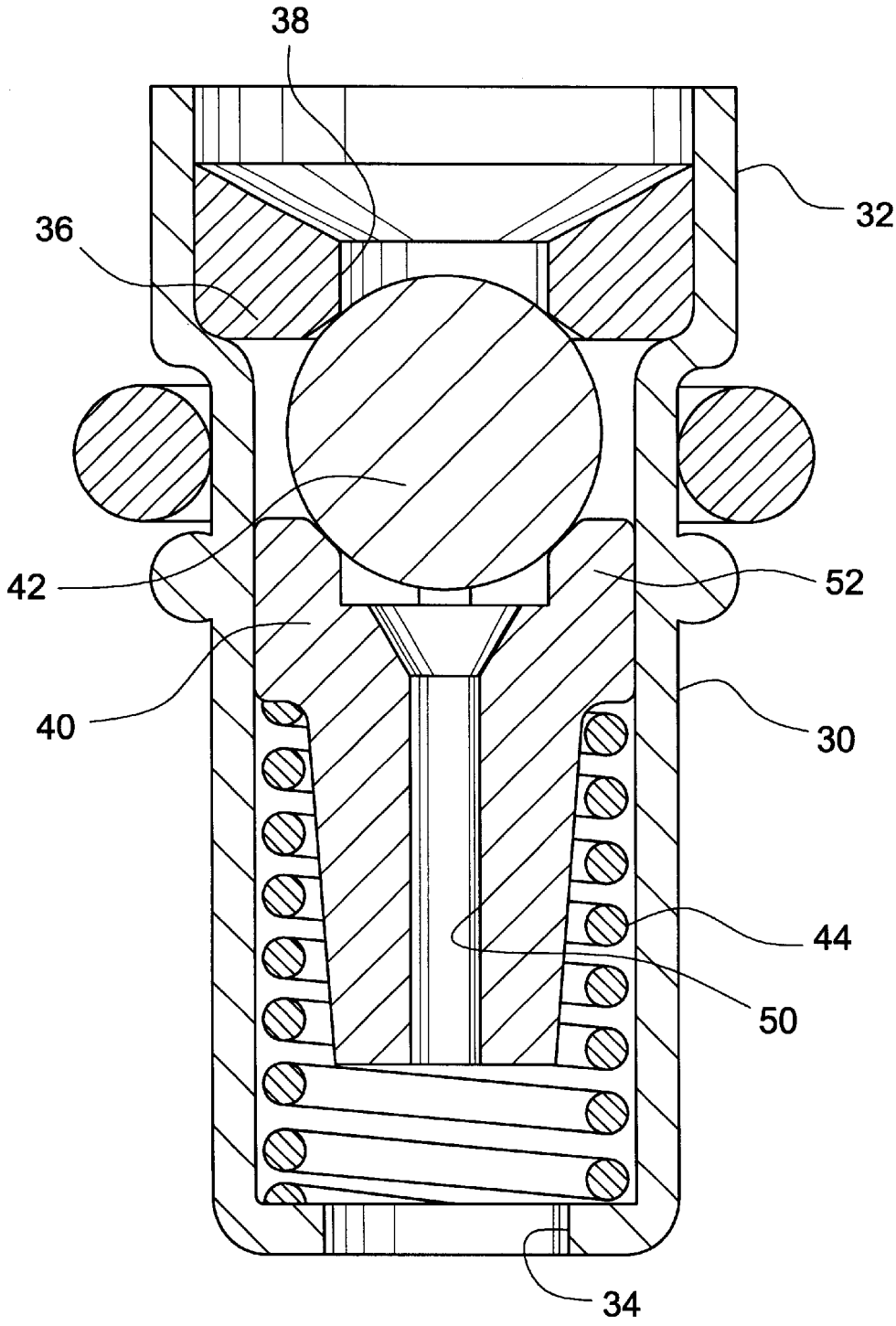
FIG. 2 is a cross-sectional view of a pressure regulator according to the present invention.
Figure 3:
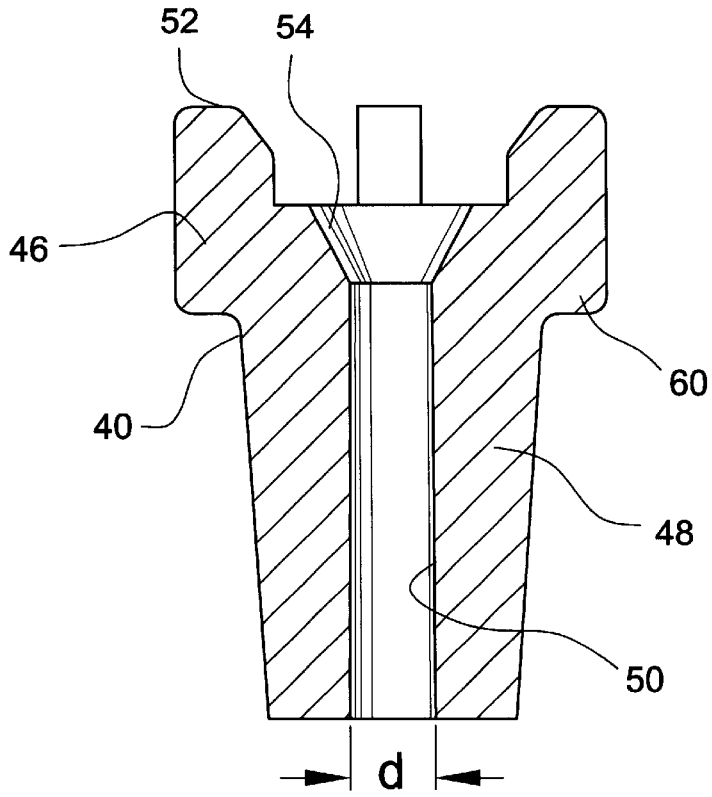
FIG. 3 is a cross-sectional view of the flow channel d rector forming part of the pressure regulator hereof.
Figure 4:
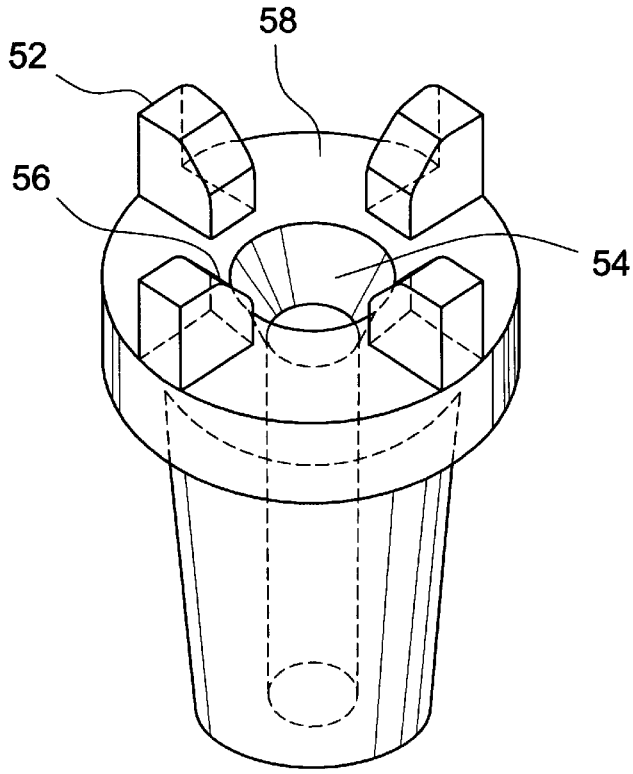
FIG. 4 is a perspective view of the channel director of FIG. 3.

Referring now to FIG. 2, the pressure regulator PR includes a housing 30 having an enlarged inlet end 32 and an aperture 34 at its opposite end. Disposed within the enlarged end 32 is a valve seat 36. Seat 36 includes an annulus having a central opening 38 forming a fuel inlet through the valve. Disposed between a flow channel director 40 and the annular valve seat 36 is a valve element, preferably a ball 42 forming part of the valve. As illustrated, the flow channel director is spring-biased by a spring 44 in a direction toward the ball 42 and valve seat 36. Referring to FIGS. 3 and 4, the flow channel director includes an enlarged diameter head portion 46 for bearing against the interior wall surface of the reduced diameter body portion 30. The director 40 includes a reduced diameter lower end 48 defining an internal flow channel 50 of constant diameter throughout the majority of its length. The upper end of the flow channel director 40 carries a plurality of circumferentially spaced, axially projecting pins or abutments 52, four being shown, and surrounding the tapered inlet 54 to the central passage 50 of the flow channel director. The pins 52 have interior inclined surfaces 56 on which ball 42 seats. In this manner, passages or channels 58 are formed circumferentially between the pins 52. Consequently, when ball 42 is seated on the inclined surfaces 56, flow channels are provided between the ball and pins into the tapered opening 54 into axial channel 50. The spring 44 seats on a shoulder 60 formed at the transition between the upper head and reduced diameter lower portion.

When the valve is disposed in the fuel line, it will be appreciated that the pressure of the fuel from the fuel pump displaces the ball 42 and the flow director 40 against the bias of spring 44 and away from the seat 36 whereby fuel flows past the ball valve and seat The fuel flow continues beyond the ball 42 for flow through the channels between the pins 52 and into the central passage 50 of the flow channel director 40.

Figure 5:
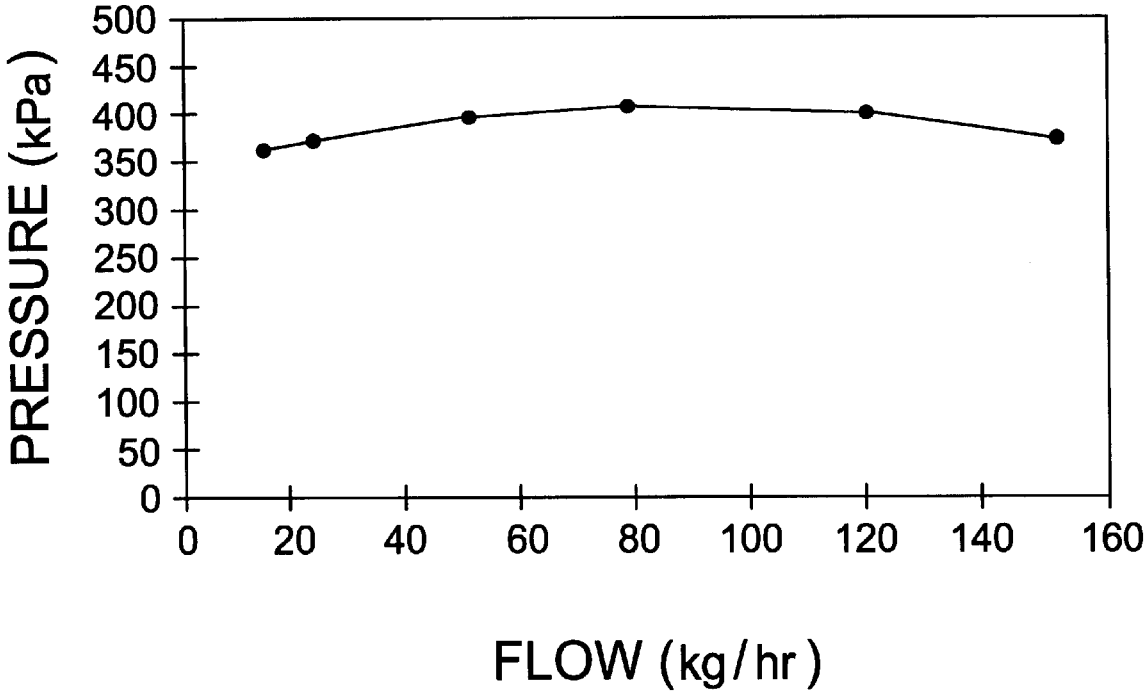
FIG. 5 is a graph representing pressure versus fuel flow for the pressure regulator hereof.

In accordance with the present invention, the valve is sized such that a substantially constant pressure is provided over the desired flow range for an automotive vehicle. Particularly, the fuel pressure is maintained substantially constant, i.e., within a range of approximately 350–420 kPa, over the typical automotive engine operating flow range of between 20 to 140 kg/hr. The pressure variation is very minimal, as indicated by the graph of FIG. 5. It has been determined that the performance of the regulator is controlled by the diameter of the internal flow passage 50. That diameter is sized according to the following equation:

$$d=(0.52\pm0.02)\sqrt{m}$$

where d is the diameter of the channel 50 in mm and m is the mass flow rate in grams per second. Consequently, a substantially constant fuel pressure is obtained with the valve sized in accordance with that equation over the full range of flow rates useful for operating an automotive engine.

Dimensionally and in a preferred embodiment, the interior surface of the housing 30 is preferably 8.1 mm and the diameter of the flow channel 50 is 1.75 mm. The taper at the upper end of the flow channel 50 is approximately 50°, while the taper between oppositely disposed inclined surfaces 56 is about 90°. The length of the flow channel 50 has little effect on the proportionality of the diameter and the flow rate.

It will also be appreciated that the valve hereof not only is reduced in the number of parts comprising the valve but its configuration and parts orientations are such as to substantially and significantly improve the manufacturability of the valve, as well as reduce its costs. Particularly, the shape of the housing is generally cylindrical with an outward step at one end 32. This enables sequential assembly of the various parts of the valve into one end of the housing and through that one end only. Thus, the spring 44, flow director 40, ball 42 and seat 36 are sequentially inserted through the open end 32 of the housing. The open end 32 may then be crimped or the valve seat 36 otherwise secured in the housing 30. Subassembly steps, such as crimping or using other tools to maintain parts in subassembly form during assembly are not necessary. With the parts reduction and ease of manufacturing, substantial cost reductions are provided in comparison with regulators previously utilized in automotive fuel systems.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A fuel system for an internal combustion engine comprising:

a fuel rail for supplying fuel to fuel injectors;

a fuel tank for containing fuel;

a fuel pump for supplying fuel from the fuel tank under pressure to the fuel rail;

a fuel pressure regulator for regulating the pressure of the fuel supplied to said fuel rail to a predetermined pressure;

said regulator including a housing and a valve seat in said housing having a fuel inlet, a valve element movable toward and away from said valve seat, a flow channel director mounting said valve element on an opposite side thereof from said seat and a spring for biasing said flow channel director and said valve element toward said valve seat, said flow channel director having a plurality of passages therethrough, said valve element being movable toward and away from said seat, enabling flow of fuel through said inlet between said valve element and seat and through said flow channel passages for regulating the fuel pressure to a substantially constant value over a predetermined range of flow.

2. A fuel system according to claim 1 wherein said regulator is sized to provide a substantially constant regulated pressure over a flow range of 20–150 kg/hr.

3. A fuel system according to claim 1 wherein said pressure regulator regulates the pressure of fuel supplied to the fuel rail to said predetermined pressure without a movable diaphragm dividing the regulator into flow and non-flow chambers on opposite sides thereof.

4. A fuel system according to claim 1 wherein said flow channel director has a single substantially constant diameter flow channel downstream of said plurality of passages which satisfies the equation:

$$d=(0.52\pm0.02)\sqrt{m}$$

where:

d=channel diameter in mm m=mass flow rate in grams per second enabling the pressure regulator to provide a substantially constant pressure over a flow range useful for automotive fuel supply systems.

5. A fuel system according to claim 4 wherein said regulator is sized to provide a substantially constant regulated pressure over a flow range of 20–150 kg/hr.

6. A fuel system according to claim 1 wherein said pressure regulator is mounted within said fuel tank.

7. A fuel system according to claim 1 wherein said pressure regulator is mounted between said fuel tank and said fuel rail.

8. A fuel system according to claim 1 wherein said pressure regulator regulates the pressure of fuel supplied to the fuel rail to said predetermined pressure without a movable diaphragm dividing the regulator into flow and non-flow chambers on opposite sides thereof, said pressure regulator constituting the sole pressure regulator between said fuel pump and said fuel rail for regulating the fuel pressure in said fuel rail.

9. A fuel system according to claim 1 wherein said regulator is sized to provide a regulator flow pressure within a range of 350–430 kPa over a flow range of 20–150 kg/hr.

10. A fuel system according to claim 1 wherein said valve element comprises a ball valve, said housing having an open end, said spring, said flow channel director, said ball valve and said valve seat being sized and configured for insertion into said housing through said one end thereof.

11. A fuel system according to claim 10 wherein said spring, said flow channel director, said ball valve and said valve seat are inserted into said housing through said one end thereof in sequence.

12. A fuel system according to claim 10 wherein said regulator includes solely said housing, said spring, said flow channel director, said ball valve and said valve seat.

13. A fuel flow system for an internal combustion engine comprising:

a fuel rail for supplying fuel to fuel injectors;

a fuel tank for containing fuel;

a fuel pump for supplying fuel from the fuel tank under pressure to the fuel rail; and a fuel pressure regulator for regulating the pressure of the fuel supplied to said fuel rail to a predetermined pressure, said pressure regulator being sized to provide a substantially constant regulated pressure over a flow range of 20–150 kg/hr and without a movable diaphragm dividing the regulator into flow and non-flow chambers on opposite sides thereof, wherein said fuel pressure regulator includes a valve seat having a fuel inlet, a valve element movable toward and away from said valve seat, a flow channel director mounting said valve element on an opposite side thereof from said seat and a spring for biasing said valve element and said channel director toward said seat, said flow director having at least a pair of passages for flowing fuel past said valve element mounted on said channel director, said flow channel director having a single substantially constant diameter flow channel downstream of said pair of passages which satisfies the equation:

$$d=(0.52\pm0.02)\sqrt{m}$$

where:

d=channel diameter in mm m=mass flow rate in grams per second enabling the pressure regulator to provide a substantially constant pressure over a flow range useful for automotive fuel supply systems.

14. A fuel system for an internal combustion engine comprising:

a fuel rail for supplying fuel to fuel injectors;

a fuel tank for containing fuel;

a fuel pump for supplying fuel from the fuel tank under pressure to the fuel rail; and a fuel pressure regulator for regulating the pressure of the fuel supplied to said fuel rail to a predetermined pressure, said pressure regulator being sized to provide a substantially constant regulated pressure over a flow range of 20–150 kg/hr and without a movable diaphragm dividing the regulator into flow and non-flow chambers on opposite sides thereof, wherein said pressure regulator is mounted within said fuel tank.

15. A fuel system according to claim 13 wherein said pressure regulator is mounted within said fuel tank.

16. A fuel system according to claim 13 wherein said pressure regulator constitutes the sole pressure regulator between said fuel pump and said fuel rail.

17. A fuel system according to claim 13 including a second pressure regulator adjacent said fuel rail, the first mentioned pressure regulator being disposed between said fuel pump and said second pressure regulator for regulating fuel pressure to a first predetermined pressure with said second pressure regulator regulating the fuel pressure in the fuel rail to a pressure lower than said predetermined pressure.

18. A fuel system according to claim 13 wherein said predetermined pressure lies within a range of 350–430 kPa over said flow range.

19. In a returnless fuel system for an internal combustion engine having a fuel rail for supplying fuel to fuel injectors, a fuel tank for containing fuel, a fuel pump for supplying fuel from the fuel tank under pressure to the fuel rail and a returnless fuel pressure regulator for regulating the pressure of the fuel supplied to said fuel rail to a predetermined pressure and located on or in a fuel supply line adjacent to the fuel rail, a method of operating the returnless fuel system comprising the steps of:

providing a second pressure regulator having a housing and a valve seat having a fuel inlet, a valve element movable toward and away from said valve seat, a flow channel director mounting said valve element on an opposite side thereof from said seat and a spring for biasing said flow channel director and said valve element toward said valve seat, said flow channel director having a plurality of passages therethrough whereby fuel flows through said inlet, between said valve element and said seat and said flow passage with the valve element being movable toward and away from said seat thereby regulating the fuel pressure to a substantially constant value over a predetermined range of flow.

20. A method according to claim 19 including regulating the pressure of the fuel flowing through the second regulator without a movable diaphragm within the second regulator.

21. A method according to claim 19 including regulating the pressure of the fuel flowing through the second regulator solely by moving the valve element toward and away from said seat.

* * * * *